US007461636B2

(12) United States Patent
Ricco et al.

(10) Patent No.: US 7,461,636 B2
(45) Date of Patent: Dec. 9, 2008

(54) DEVICE FOR CONNECTION BETWEEN A RAIL FOR FUEL UNDER PRESSURE AND AT LEAST ONE INJECTOR, FOR AN INTERNAL-COMBUSTION ENGINE

(75) Inventors: Mario Ricco, Casamassima (IT); Sisto Luigi De Matthaeis, Valenzano (IT); Raffaele Ricco, Valenzano (IT); Alfonso Di Meo, Valenzano (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 295 days.

(21) Appl. No.: 11/356,313

(22) Filed: Feb. 17, 2006

(65) Prior Publication Data

US 2007/0006848 A1 Jan. 11, 2007

(30) Foreign Application Priority Data

Jul. 8, 2005 (EP) ..... 05425484

(51) Int. Cl.
*F02M 55/02* (2006.01)
*F02M 69/46* (2006.01)

(52) U.S. Cl. ..... 123/456

(58) Field of Classification Search ..... 123/456, 123/468, 469

See application file for complete search history.

(56) References Cited

U.S. PATENT DOCUMENTS

| | | | | |
|---|---|---|---|---|
| 4,900,180 | A | 2/1990 | Takikawa | |
| 5,120,084 | A * | 6/1992 | Hashimoto | 285/133.11 |
| 5,169,182 | A | 12/1992 | Hashimoto | |
| 5,775,302 | A * | 7/1998 | Guido et al. | 123/468 |
| 5,957,507 | A * | 9/1999 | Asada | 285/189 |
| 6,463,909 | B2 | 10/2002 | Asada et al. | |
| 6,609,502 | B1 | 8/2003 | Frank | |
| 6,698,801 | B1 * | 3/2004 | Boecking | 285/288.1 |
| 6,736,431 | B2 * | 5/2004 | Jung et al. | 123/456 |
| 6,871,638 | B2 | 3/2005 | Kondo | |
| 6,981,722 | B2 * | 1/2006 | Watanabe | 123/456 |
| 7,004,145 | B2 * | 2/2006 | Zander | 123/456 |
| 7,137,652 | B2 * | 11/2006 | Kondo et al. | 123/456 |
| 7,275,521 | B2 * | 10/2007 | Usui et al. | 123/468 |
| 2001/0009148 | A1 * | 7/2001 | Asada et al. | 123/456 |
| 2005/0005910 | A1 * | 1/2005 | Usui et al. | 123/456 |
| 2005/0045152 | A1 * | 3/2005 | Zander | 123/456 |
| 2005/0098159 | A1 * | 5/2005 | Nishiwaki | 123/468 |

FOREIGN PATENT DOCUMENTS

| | | |
|---|---|---|
| DE | 40 30 486 A1 | 4/1991 |
| GB | 239 297 A | 6/1991 |

* cited by examiner

*Primary Examiner*—Stephen K. Cronin
*Assistant Examiner*—Arnold Castro
(74) *Attorney, Agent, or Firm*—Jacobson Holman PLLC

(57) ABSTRACT

The device includes a connection tube in communication with a hole of a rail for fuel under pressure, the tube being provided with an end swelling. The device has a first threaded element fixed to the rail in a position corresponding to the hole and a second threaded element designed to engage the first threaded element. Removably set between the hole and the swelling is a seal element designed to form a seal both with the hole and with the swelling. The seal element is a body of revolution equipped with a passage along a pre-set axis, and includes two end noses designed to be inserted in the swelling and in the hole, respectively, and two tapered seal stretches.

21 Claims, 6 Drawing Sheets

DEVICE FOR CONNECTION BETWEEN A RAIL FOR FUEL UNDER PRESSURE AND AT LEAST ONE INJECTOR, FOR AN INTERNAL-COMBUSTION ENGINE

BACKGROUND OF THE INVENTION

1. Field of the Invention

The present invention relates to a device for connection between a rail for fuel under pressure and at least one injector, for an internal-combustion engine.

2. Description of the Related Art

As is known, in injection engines the rail for fuel under pressure, common for all the injectors, is connected to the injectors themselves by means of metal tubes. The rail has a tubular shape and has an external diameter in the region of 30 mm, an internal diameter in the region of 10 mm, and a weight of approximately 3 kg. The tubes are normally connected to the rail by welding and have the only function of hydraulic connection. In turn, the rail is fixed on the engine block by means of an appropriate supporting plate. Both this plate and the rail require a considerable space in the engine compartment, so that their placing on the engine is rather complicated, and the injection system proves relatively heavy and costly.

From the document No. EP 0866 221 A1, a common rail for fuel is known having a reduced diameter, on which the tubes have an end with oversized external diameter, i.e., a swelling, which engages in a fluid-tight way a conical seat present on the rail. Each tube is fixed via a connection element carried by the rail, screwed on which is a ring nut designed to press directly on the swelling of the tube, to ensure tightness thereof with the conical seat. The connection element is fixed on the rail by welding, or force fitted.

The above connection device presents various drawbacks. In the first place, since the diameter of the rail is rather contained to reduce its weight, cost and overall dimensions, and since the size of the swelling of the tube is not smaller than a minimum diameter of encumbrance, the conical seat designed to house the swelling of the tube entails a diameter to ensure tightness of the swelling on the rail at a radial level of the rail that is too external. On account of the high operating pressures, said fit consequently proves structurally critical.

In addition, since the swelling of the tube is in direct contact with the rail, without any intermediate connection, it is not possible to set, between the rail itself and each tube, a calibrated restriction for hydraulically uncoupling the tube from the rail. The direct seal of the swelling of the tube on the rail penalizes the flexibility of the system, so that any even slight misalignment of the axis of the tube with respect to the axis of the conical seat of the rail, for example due to normal activities of maintenance of the engine, could jeopardize its tightness.

Finally, since in couplings for high-pressure tightness between two elements it is often necessary to adopt materials with different hardnesses to improve tightness thereof, in the initial assembly the element made of softer material undergoes permanent plastic deformations. Consequently, should the two elements be uncoupled, it would no longer be possible to guarantee tightness in the subsequent assembly. In general, the softer material is adopted for the less costly component, which must then be replaced whenever it is uncoupled. It is evident that, if for reasons of simple maintenance the tubes were to be removed from the rail, it would be necessary to replace also the tubes or the rail, according to the choice made for the element of softer material, with evident prejudice from the economic standpoint.

SUMMARY OF THE INVENTION

The aim of the invention is to provide a device for connection between a fuel rail and a set of injectors for an internal-combustion engine, which will present high reliability and limited cost, eliminating the drawbacks of the connection devices of the known art.

According to the present invention, the above aim is achieved by a connection device between a rail for fuel under pressure and at least one injector for an internal-combustion engine. The device includes a connection tube in communication with a hole of the rail, the tube being provided with an end swelling, a first threaded element, fixed to the rail in a position corresponding to the hole, and a second threaded element, designed to engage the first threaded element, for blocking the swelling in the first threaded element. A seal element is removably set between the hole and the swelling and designed to form a seal both with the hole and with the swelling, the seal element having a body of revolution equipped with a passage along a pre-set axis. The body of revolution has two end noses designed to be inserted in the swelling and the hole, respectively, and a central flange set between the two end noses, each of the noses having a tapered sealing stretch. The hole and/or the swelling are provided with corresponding conical seats each designed to be engaged by a corresponding tapered stretch.

BRIEF DESCRIPTION OF THE DRAWINGS

For a better understanding of the invention some preferred embodiments are described hereinafter, purely by way of example, with the aid of the attached plate of drawings, wherein.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
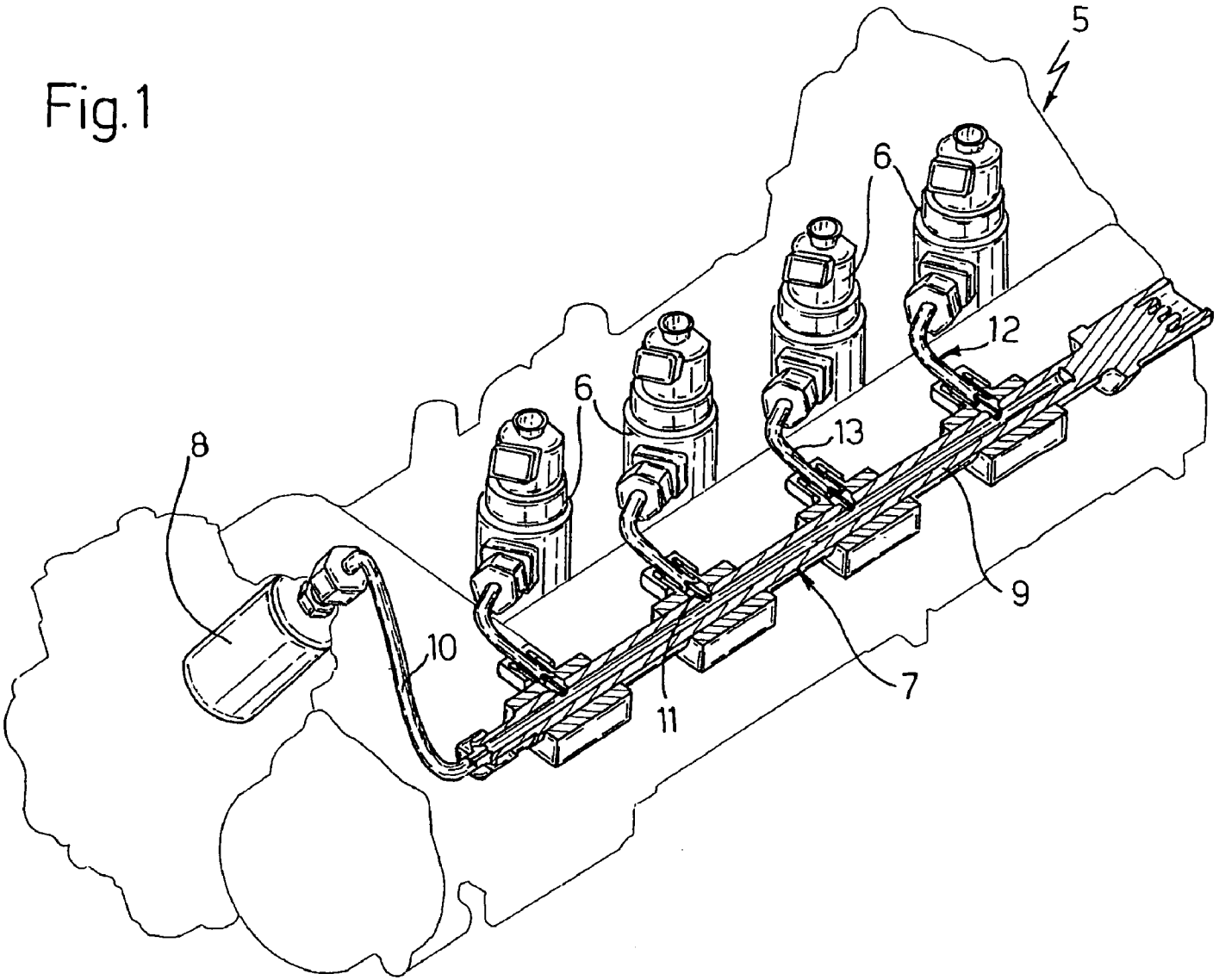
FIG. 1 is a partially sectioned perspective view of an internal-combustion engine equipped with a fuel rail with a connection device according to the invention.

With reference to FIG. 1, number 5 designates as a whole an internal-combustion engine, for example a four-cylinder diesel-cycle engine. The engine 5 is equipped with four injectors 6 associated to the cylinders, which are supplied by a common rail 7 for fuel under pressure, supplied by a high-pressure pump 8. The rail 7 has a hollow body 9 substantially of a cylindrical shape, and is connected to the pump 8 via a high-pressure duct 10.

The rail 7 is provided with a series of radial holes 11 associated to the injectors 6. Each injector 6 is connected to the rail 7 in a position corresponding to the respective radial hole 11, by means of a connection device, designated as a whole by 12. The device 12 comprises a metal tube 13, having standard external and internal diameters. The holes 11 are normally aligned along a generatrix of the cylinder of the hollow body 9.

Figure 2:
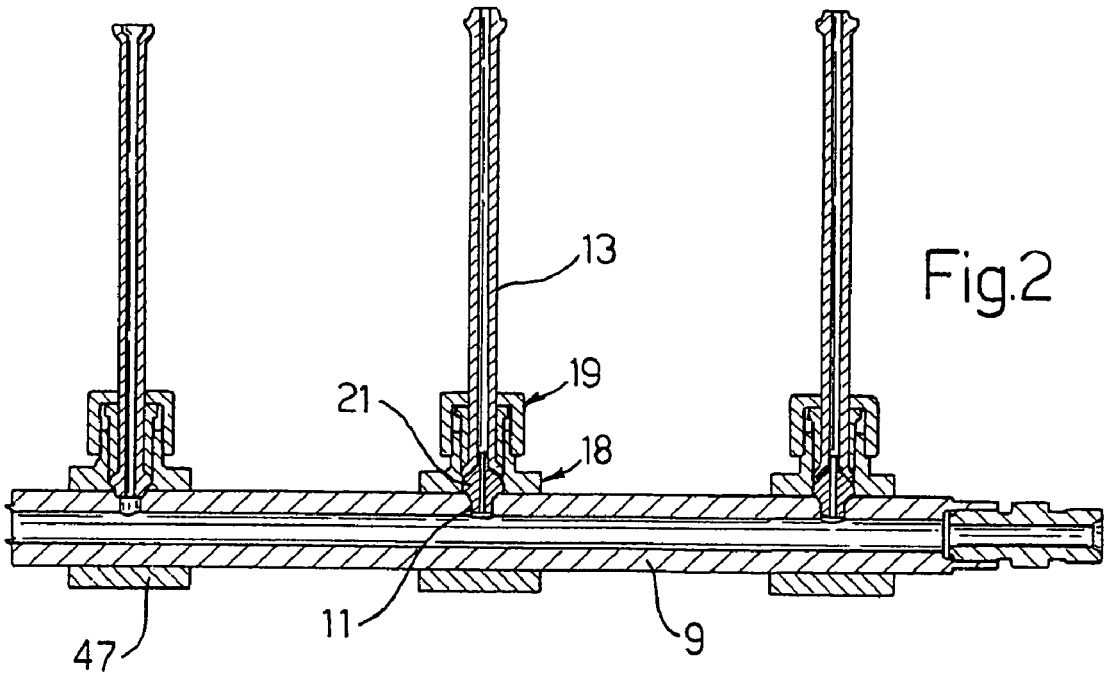
FIG. 2 is a partial median section of a fuel rail, equipped with a connection device according to a first embodiment of the invention.

Each hole 11 has a pre-set diameter and is flared outwards so as to form a conical seat 14 (FIGS. 2 and 3), which must be machined precisely. The internal diameter of the tube 13 is substantially smaller than that of the hole 11. The tube 13 is moreover formed with an end having an oversized external diameter so as to form a swelling 16 having a shoulder 17, substantially shaped like a truncated cone. The connection device 12 comprises a first threaded element 18, fixed to the rail 7 in a position corresponding to each hole 11, and a second threaded element 19 designed to engage the first threaded element 18 for blocking the swelling 16 of the tube 13 on the rail 7.

According to the invention, set between the hole 11 and the swelling 16 of the tube 13 is a removable seal element, designated as a whole by 21, which is designed to be coupled in a fluid-tight way both to the conical seat 14 of the hole 11 and with the swelling 16 of the tube 13. In particular, in a position corresponding to the swelling 16, the tube 13 has another conical seat 22 having a flared surface shaped like a truncated cone. Said conical seat 22 is more or less extensive according to the material and the profile adopted for the seal element 21 and sometimes can be just sketched. The seal element 21 has the shape of a body of revolution 23 (FIGS. 4 and 5) and is equipped with a passage 25 having an axis A and with a first cylindrical end nose 26, which has an external diameter substantially equal to the internal diameter of the tube 13, and is hence designed to be guided within the swelling 16 (see also FIG. 3) of the tube 13.

The body 23 comprises a central flange 24 having a diameter usually equal to the external diameter of the swelling 16, and a second cylindrical end nose 27 designed to be guided in the hole 11 of the hollow body 9. Between the flange 24 and the nose 26, the body 23 has a tapered stretch 28, machined so as to form a seal with the conical seat 22 of the swelling 16.

Figure 5:
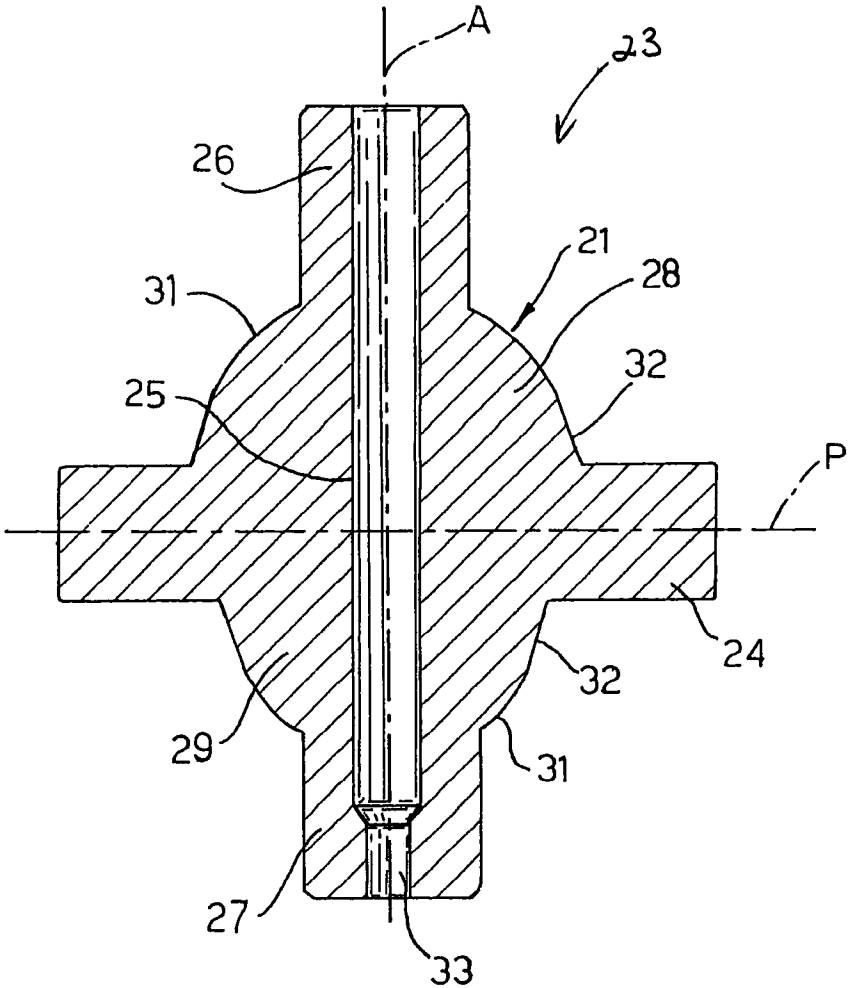
FIGS. 4 and 5 illustrate two variants of a seal element of the connection device, at a very enlarged scale.
Figure 4:
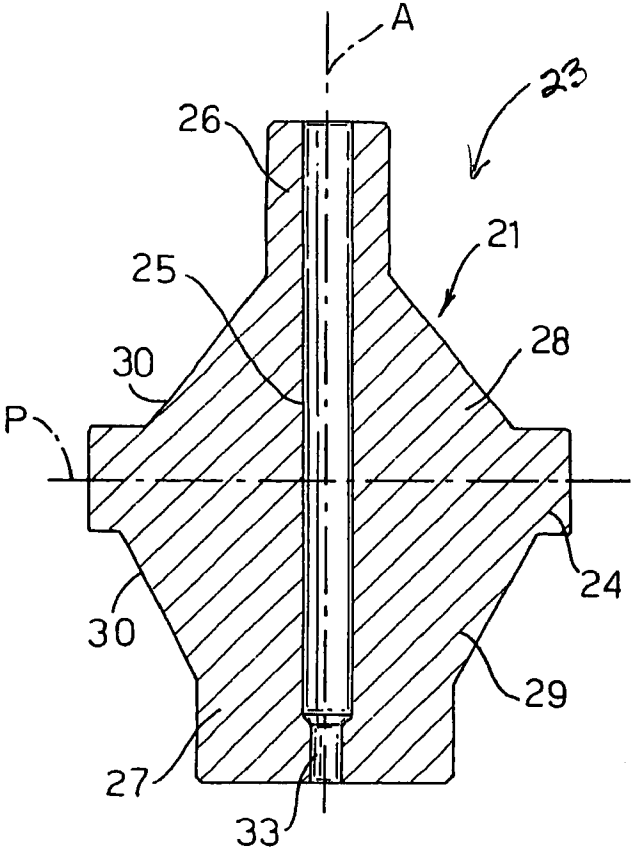

Between the flange 24 and the other nose 27, the body 23 has another tapered stretch 29, machined so as to form a seal with the conical seat 14 of the hole 11. The two parts 26, 28 and 27, 29 of the body 23 may not be the same as one another, as indicated in the variants of FIGS. 4 and 5. Alternatively, the two parts 26, 28 and 27, 29 of the body 23 can be the same as one another and hence symmetrical with respect to a plane P perpendicular to the axis A and passing through the middle of the flange 24.

According to a first variant of the seal element 21, each tapered stretch 28, 29 (FIG. 4) has an outer surface 30 shaped like a truncated cone, with an angle at the vertex slightly smaller than that of the conical seat 22 of the swelling 16 and that of the conical seat 14 of the hole 11, respectively. In this way, the sealing diameter for the two couplings in series (tube 13-element 21; element 21-rail 7) is defined in a position corresponding to the minimum diameter of the conical seat 22 of the swelling 16 and to the minimum diameter of the conical seat 14 of the hole 11, respectively.

For hydraulic reasons (contained injection-pressure oscillations in the various operating conditions of the engine), the sealing diameter is fixed according to the internal diameter of the hollow body 9, which is determined on the basis of the minimum external diameter of the hollow body 9, in such a way that the thickness of the body 9 will enable a good structural sturdiness. In addition, each tapered stretch 28, 29 between the seal element 21 and the conical seat 14 of the hole 11 of the hollow body 9 is appropriately sized at a radial level of the hollow body 9 itself, in such a way that its structural sturdiness will not be jeopardized.

According to another variant of the seal element 21, each of the tapered stretches 28, 29 (FIG. 5) has a portion 31 having the shape of a spherical cap, and a portion 32 shaped like a truncated cone, which is set between the flange 24 and the respective portion 31 having the shape of a spherical cap. In the variant of FIG. 5, the portions 31 having the shape of a spherical cap function as hinge, so that this variant presents the advantage of enabling tightness even though there is a certain misalignment between the axis of the hole 11 of the body 9 and the axis of the seat 22 of the swelling 16 of the tube 13.

In addition, assuming a pre-set diameter for the portion 31 having the shape of a spherical cap, it is possible to define uniquely the sealing diameter. Consequently, once the tightening torque for the threaded element 19 is fixed, it is possible to determine the stresses exchanged between the seal element 21 and the rail 9. The tightening torque applied will be consequently chosen in such a way as not to induce stresses above the structural limit value for the components of the system. A similar process is followed for the portion 32 of the tapered stretch 28 having the shape of a spherical cap, which determines the stresses exchanged between the tube 13 and the element 21.

The passage 25 of the seal element 21 has a circular cross section and comprises a portion 33 of reduced diameter. The portion 33 is designed to be set towards the hole 11 or alternatively towards the swelling 16, for the purpose of reducing the dependence of the amount of fuel injected upon the pressure waves in the rail 7.

As is known, in modern injection engines, having a common fuel rail, control of the delivery of the pump 8 and of the corresponding synchronization with the injection enables reduction to the minimum of the size of the rail itself. The latter can hence have an external diameter reduced to less than 20 mm, and an internal diameter of approximately 7.5 mm, with a total weight of approximately 1 kg.

According to a first embodiment of the invention, the first threaded element 18 has the function of connection element and comprises a sleeve 34 (FIG. 3) made of a single piece with a supporting portion 36 for fixing on the rail 7. The sleeve 34 has an external thread 37, and has an internal diameter greater than that of the tube 13. The second threaded element 19 comprises a ring nut 38, having a prismatic outer surface and an internal thread 39 designed to engage with the thread 37 of the sleeve 34. Consequently, any possible swarf due to machining or to wear of the two threads 37 and 39 is not able to reach the seal element 21.

The ring nut 38 has a top wall 41, having a central opening 42 for the passage of the tube 13. Set in the sleeve 34 is a bushing 43 having an internal diameter substantially equal to the external diameter of the tube 13. The bushing 43 is moreover provided with a top flange 44, designed to be engaged by the wall 41 of the ring nut 38, and with a bottom edge 46 flared so as to engage the shoulder 17 of the swelling 16 correctly.

Figure 6:
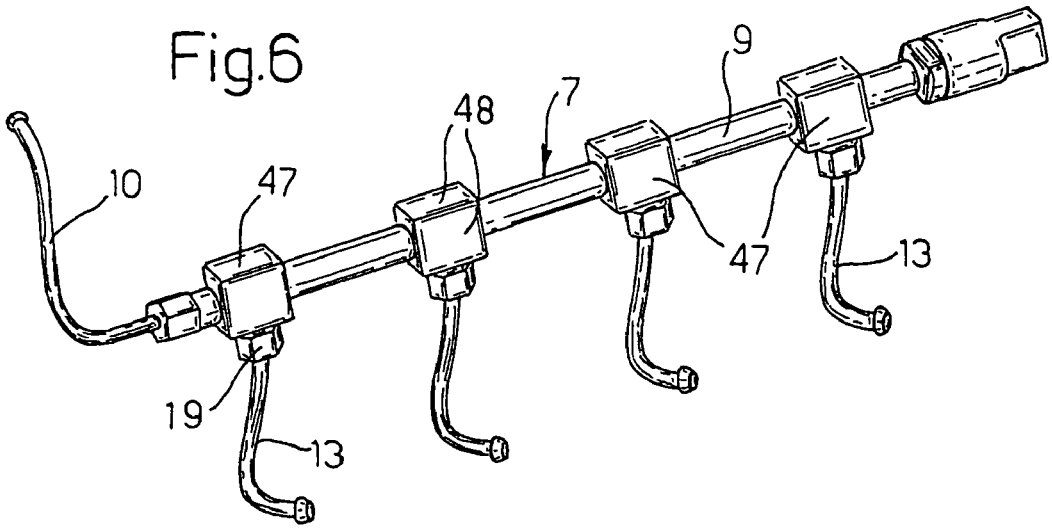
FIG. 6 is a perspective view of the rail of FIG. 2.

The support 36 for the sleeve 34 is formed by a ring 47 designed to be force fitted on the body 9 of the rail 7, for example by prior thermal expansion. Alternatively, the internal diameter of the ring 47 can be slightly larger than the external diameter of the hollow body 9 so that blocking of any axial displacement of the support 36 with respect to the hollow body 9 is entrusted to the seal element 21, which now functions as a key. The ring 47 (FIG. 6) has a prismatic outer surface 48 for enabling angular positioning thereof. Alternatively, the outer surface 48 can be cylindrical.

When the ring nut 38 is screwed on the sleeve 34, the wall 41 acts on the flange 44 pushing the bushing 43 towards the seal element 21. The edge 46 engages the shoulder 17 of the swelling 16, which is pushed in the direction of the seal element 21, until the desired tightness is achieved both on the conical seat 14 of the hole 11 and on the conical seat 22 of the swelling 16. In this way, the tube 13 is rigidly guided and fixed on the threaded element 18. Consequently, also by virtue of the contained weight, the rail 7 can be supported directly by the tubes 13, thus eliminating the usual plate for fixing of the rail on the engine.

Figure 7:
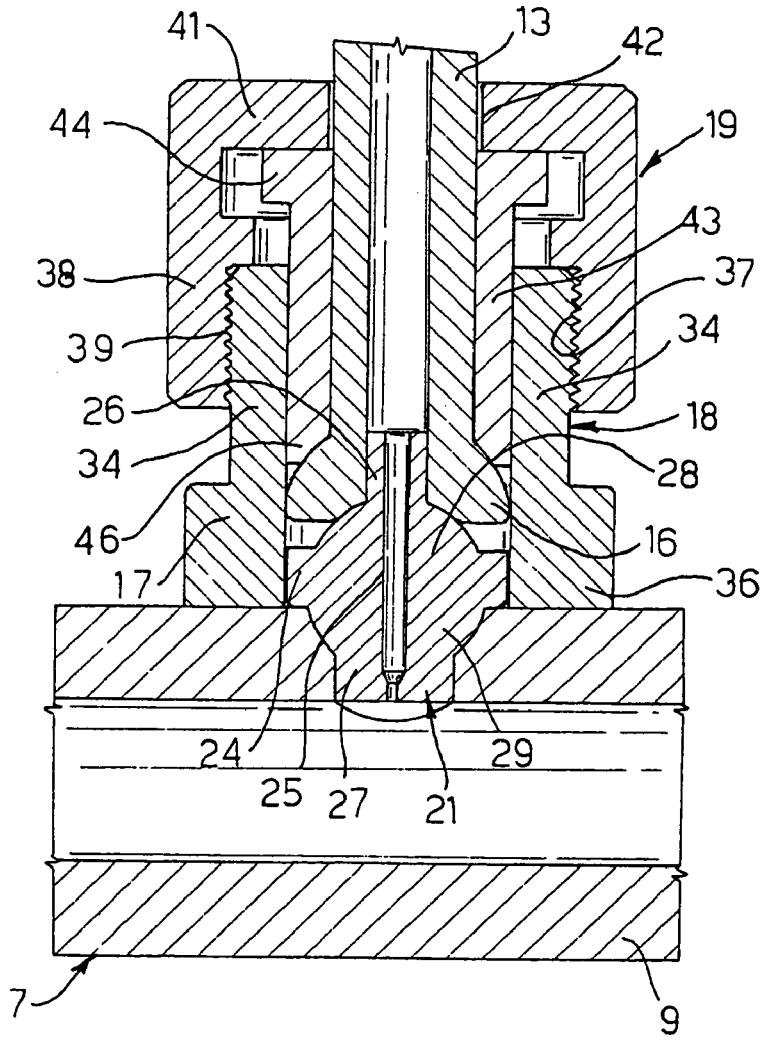
FIGS. 7 and 8 illustrate the detail of FIG. 3 according to other two embodiments of the invention.

According to another embodiment of the invention illustrated in FIG. 7, the support 36 is of the saddle type and is directly welded on the body 9 of the rail 7.

Figure 8:
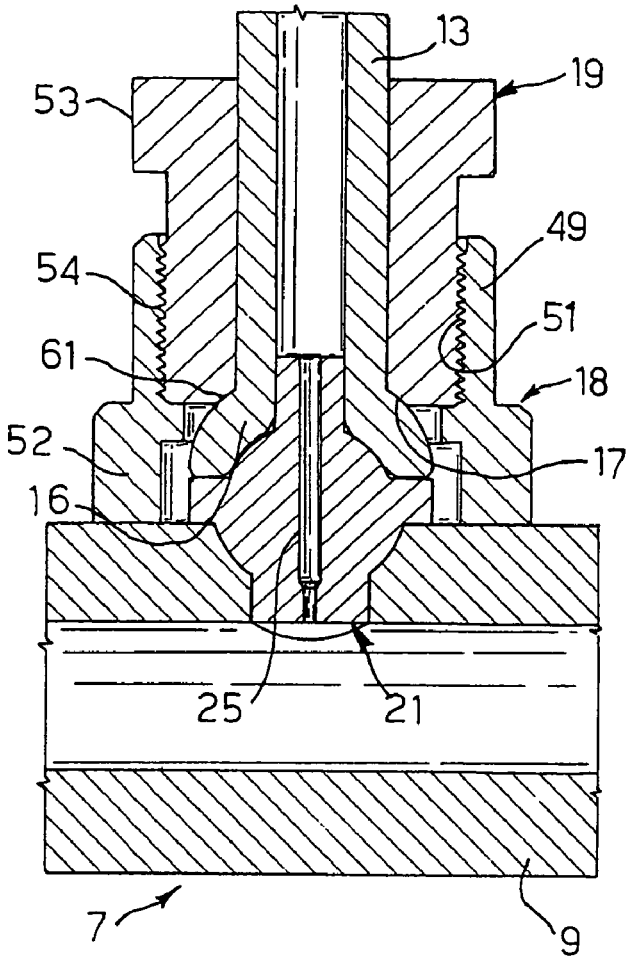

According to a further embodiment of the invention illustrated in FIG. 8, the first threaded element 18 comprises a sleeve 49 having an internal thread 51, and a supporting portion 52 for fixing on the body 9 of the rail 7. The second threaded element 19 comprises a prismatic ring nut 53 having an external thread 54 designed to engage the thread 51 of the sleeve 49. The ring nut 53 has an internal diameter substantially equal to the external diameter of the tube 13 and is provided with a bottom edge 61 designed to engage the shoulder 17 of the swelling 16 so that no additional bushing is necessary. The support 52 is of the saddle type and is directly welded on the body 9 of the rail 7.

Figure 9:
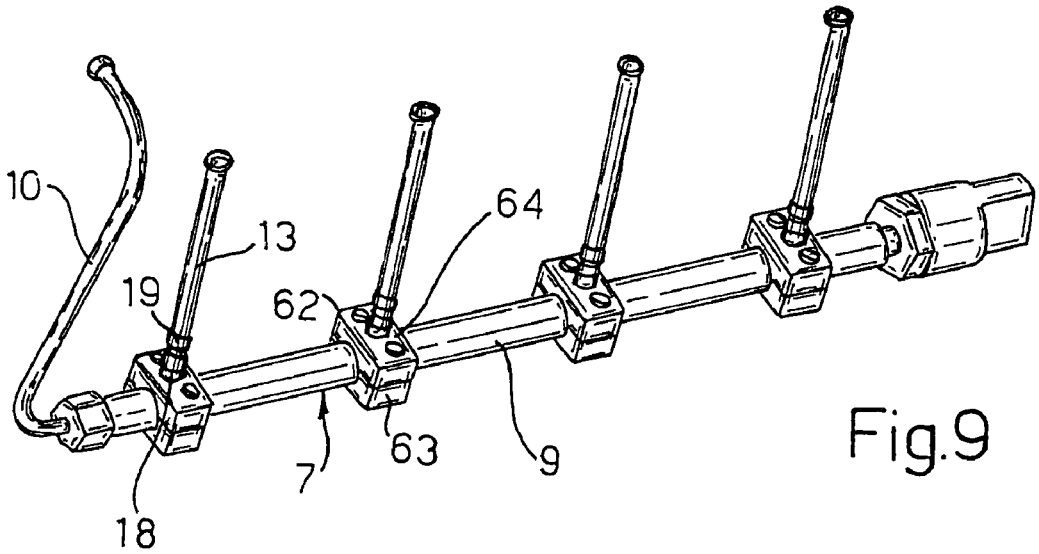
FIG. 9 is a perspective view of a rail equipped with a connection device according to a further embodiment of the invention.

Illustrated in FIG. 9 is a rail 7 in which the threaded elements 18 are fixed by means of two half-rings 62 and 63, of which the half-ring 62 is made of a single piece with the sleeve 51 and is designed to be fixed on the other half-ring 63 by means of at least two bolts with nuts 64. In this way, the two half-rings 62 and 63 are forced on the body 9 of the rail 7.

When the ring nut 53 is screwed in the sleeve 49, the edge 61 engages the shoulder 17 of the swelling 16, which is pushed towards the seal element 21, until the desired tightness is obtained, both on the conical seat 14 of the hole 11 and on the conical seat 22 of the swelling 16.

Figure 3:
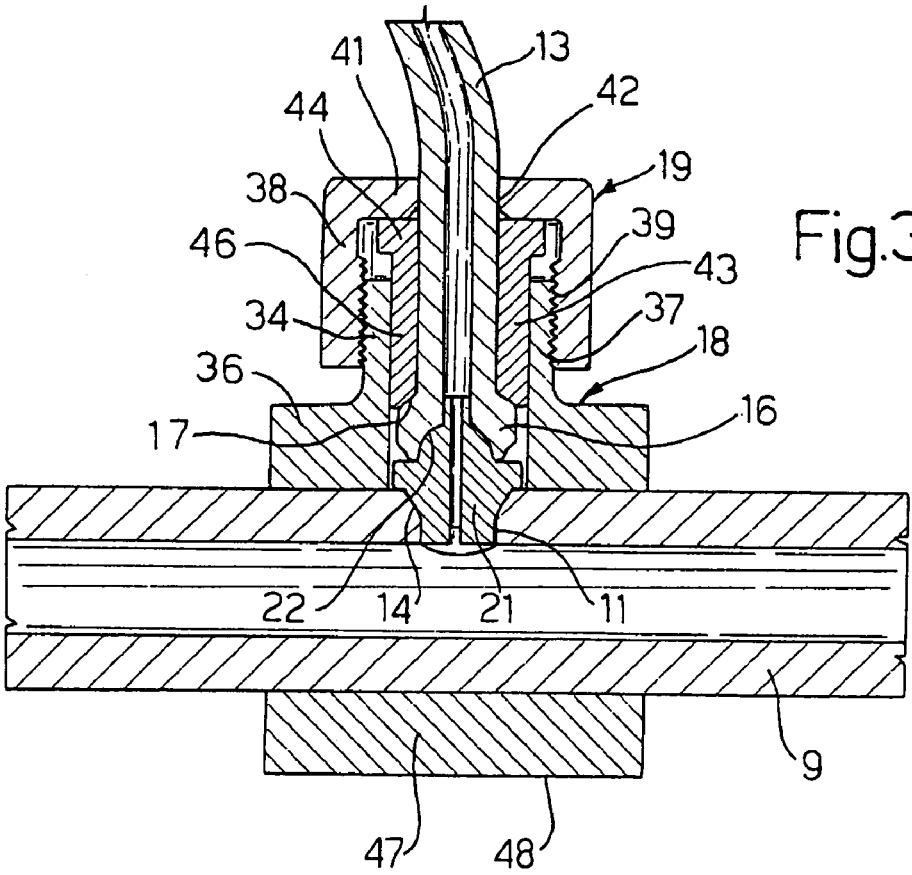
FIG. 3 is a detail of FIG. 2 at an enlarged scale.
Figure 10:
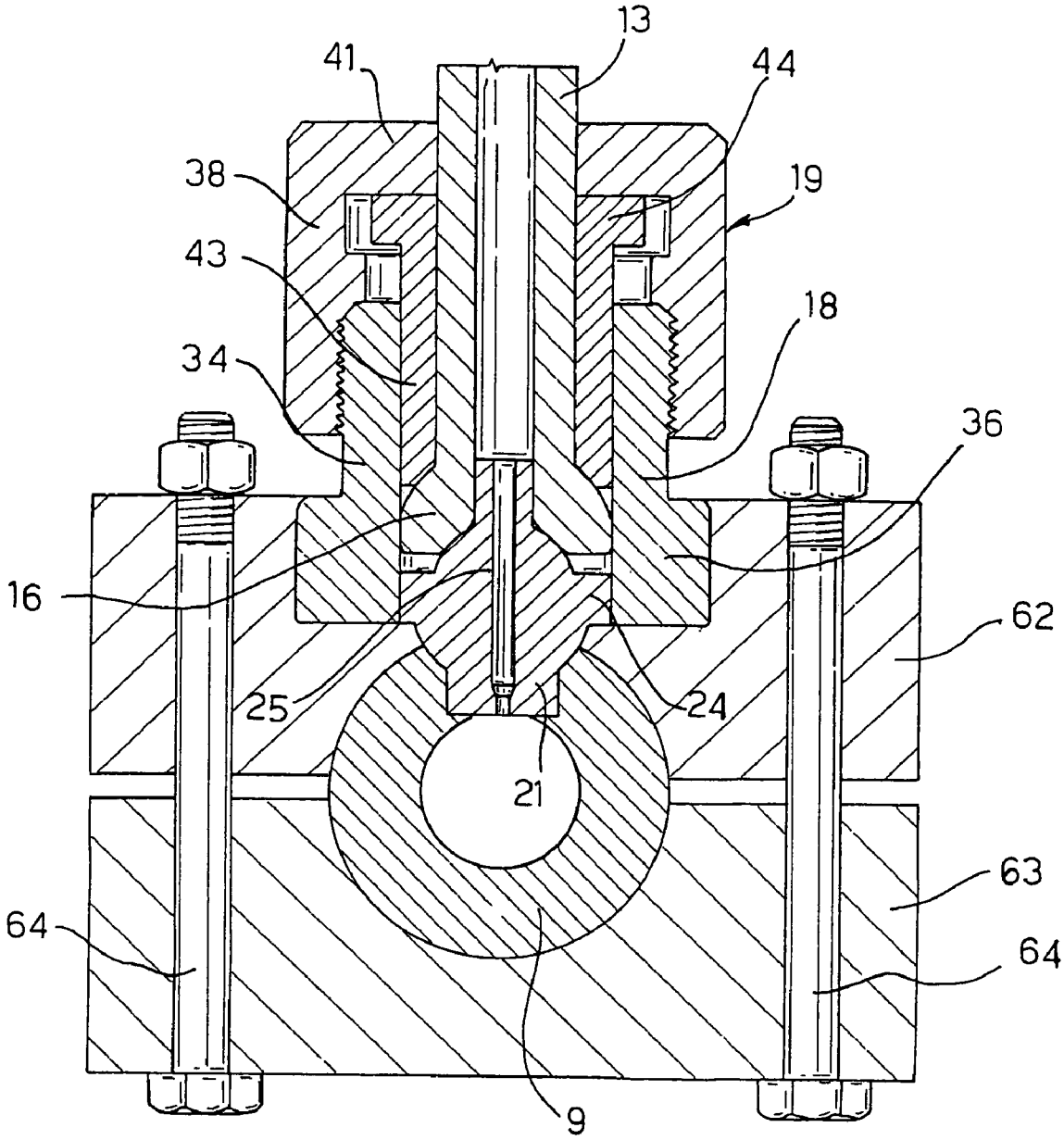
FIG. 10 is a cross section of the connection device of FIG. 9.

According to a further embodiment of the invention illustrated in FIG. 10, the sleeve 34 and the ring nut 38 are similar to those of FIGS. 3 and 7. The threaded element 18 is made of a single piece with the half-ring 62 and is fixed on the body 9 by means of the other half-ring 63 as in FIG. 9. Obviously, it is possible to have a threaded element 18 similar to that of FIG. 8, fixed on the body 9 by means of the half-rings 62 and 83 of FIG. 10.

From the foregoing description, the advantages of the connection device according to the invention as compared to the known art are evident. In particular, the removable seal element 21 enables use of commercially available tubes 13, in which the swelling 16 is formed with simple machining operations. By appropriately sizing the end noses 26, 27 of the seal element 21, it is consequently possible to reduce the sealing diameter as compared to that defined by a direct coupling of the swelling 16 of the standard tube 13 with the hole 11 of the rail 7, and between the element 21 and the conical seat 14 of the hole 11 of the rail 7, thus increasing the structural sturdiness of the rail 7. This can now enable a contained external diameter, since the tightness between the element 21 and the rail 7 occurs at a lower radial level.

In addition, by adopting a relatively soft material for the seal element 21, it is possible to preserve from permanent plastic deformations both the tubes 13 and the rail 7 itself, with the evident economical advantage of not having to replace either the tubes or the rail 7 during normal maintenance operations. In fact, during said operations, should it be necessary, only the element 21 of lower cost as compared to the other components would be replaced. The element 21, especially in the embodiment provided in FIG. 5, enables a greater flexibility of the system, since a certain misalignment of the axis of the tube 13 is now allowed with respect the axis of the hole 11 of the rail 7.

In addition, the guide bushing 43 and the ring nut 53, by guiding exactly the tube 13, enable direct support of the rail 7, thus eliminating the usual fixing plate for connection of the rail 7 on the engine block 5. Finally, the restriction 33 present in the element 21 enables a reduction in the dependence of the amount of fuel injected upon the pressure waves in the rail 7. Said restriction would in fact be difficult to obtain in the case where, in the absence of the element 21, it were necessary to make it directly in the tube 13 or in the rail 7.

It is understood that various modifications and improvements may be made to the connection device described above without departing from the scope of the claims. For example, the holes 11 can be arranged on different generatrices of the body 9. In addition, the shape and the material of the seal element 21 and/or the connection of the threaded element 18 with the body 9 can be varied. In FIGS. 3, 7 and 10 the bushing 43 can be eliminated, providing the threaded element 18 with an internal diameter equal to the external diameter of the tube 13. The flange 24 can also be eliminated or just slightly sketched, so that the two end noses 26, 27 are joined directly by the respective tapered stretches 28, 29, without jeopardizing the functionality of the seal element 21.

Finally, if the end nose 26 of the seal element 21 is appropriately sized, the shoulder 17 of the swelling 16 of the standard tube 13 can coincide with the original profile of the tube 13, without having to resort to further machining operations on the tube 13 itself.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A device for connection between a rail for fuel under pressure and at least one injector for an internal-combustion engine, comprising a connection tube for said injector in communication with a hole of said rail, said tube being provided with an end swelling, a first threaded element fixed to said rail in a position corresponding to said hole, and a second threaded element designed to engage said first threaded element for blocking said swelling in said first threaded element, and a seal element designed to form a seal both with said hole and with said swelling, said seal element being a body of revolution equipped with a passage along a pre-set axis, said body of revolution being removably set between said hole and said swelling, said body of revolution having two end noses designed to be inserted respectively in said swelling and in said hole, and a central flange set between said two end noses.

2. The device according to claim 1, wherein said rail includes a substantially cylindrical hollow body provided with a plurality of holes associated to said injectors, said holes being arranged along a generatrix of said hollow body, said hollow body having a reduced diameter and being set adherent to said injectors.

3. The device according to claim 2, wherein each said first threaded element includes a sleeve equipped with an external thread, said second threaded element having a ring nut provided with an internal thread and designed to act on said swelling through a bushing having an internal diameter such as to guide rigidly said tube and to ensure fixing of said hollow body on the engine via said connection tubes.

4. The device according to claim 1, wherein each said first threaded element is formed by a sleeve having an internal thread, said second threaded element having a ring nut with an external thread and designed to act directly on said swelling, said ring nut having an internal diameter such as to guide rigidly said tube and to ensure fixing of said hollow body on the engine via said connection tubes.

5. A device for connection between a rail for fuel under pressure and at least one injector for an internal-combustion engine, comprising a connection tube in communication with a hole of said rail, said tube being provided with an end swelling, a first threaded element, fixed to said rail in a position corresponding to said hole, and a second threaded element, designed to engage said first threaded element, for blocking said swelling in said first threaded element, a seal element removably set between said hole and said swelling and designed to form a seal both with said hole and with said swelling, said seal element having a body of revolution equipped with a passage along a pre-set axis, said body of revolution having two end noses designed to be inserted in said swelling and said hole, respectively, and a central flange set between said two end noses, each of said noses having a tapered sealing stretch, said hole and/or said swelling being provided with corresponding conical seats each designed to be engaged by a corresponding tapered stretch.

6. The device according to claim 5, wherein said body has a plane perpendicular to said axis and passing through the middle of said flange.

7. The device according to claim 6, wherein said plane is a plane of symmetry of said body, perpendicular to said axis.

8. The device according to claim 5, wherein each of said tapered stretches of said noses includes a portion shaped like a spherical cap.

9. The device according to claim 8, wherein each of said tapered stretches of said noses further includes a portion shaped like a truncated cone.

10. The device according to claim 9, wherein said portion shaped like a truncated cone is set between said flange and said portion shaped like a spherical cap.

11. The device according to claim 5, wherein said passage has a circular cross section and includes a portion of reduced diameter designed to be set in a position corresponding to said hole or in a position corresponding to said swelling.

12. The device according to claim 5, wherein said seal element is made of a material that is relatively softer than that of said tubes and of said rail.

13. The device according to claim 5, wherein said first threaded element includes a sleeve equipped with an external thread, said second threaded element having a ring nut provided with an internal thread and designed to act on said swelling through a bushing.

14. The device according to claim 13, wherein said rail includes a substantially cylindrical hollow body, said bushing having an internal diameter such as to guide rigidly said tube and such as to ensure fixing of said hollow body on the engine via said tube.

15. The device according to claim 5, wherein said first threaded element is formed by a sleeve having an internal thread, said second threaded element including a ring nut having an external thread and designed to act directly on said swelling.

16. The device according to claim 15, wherein said ring nut has an internal diameter such as to guide rigidly said tube and to ensure fixing of said hollow body on the engine via said tube.

17. The device according to claim 14, wherein said first threaded element has a saddle-shaped portion welded on said hollow body.

18. The device according to claim 14, wherein said first threaded element is carried by a ring embracing said hollow body.

19. The device according to claim 14, wherein said first threaded element is carried by a half-ring support designed to be fixed on said hollow body by another half-ring, said half-rings being connected together by bolts with nuts.

20. The device according to claim 14, wherein a number of holes are arranged along a generatrix of said hollow body, each of said holes being associated to a corresponding first threaded element, said hollow body having a reduced diameter and being set adherent to said injectors.

21. The device according to claim 5, wherein each of said tapered stretches of said noses is shaped like a truncated cone.

* * * * *